US005112291A

United States Patent [19]

VerMehren

[11] Patent Number: 5,112,291

[45] Date of Patent: May 12, 1992

[54] OVERBENDING DEVICE

[76] Inventor: H. Richard VerMehren, 2626 Woodson Rd., St. Louis, Mo. 63141

[21] Appl. No.: 688,370

[22] Filed: Apr. 19, 1991

Related U.S. Application Data

[63] Continuation of Ser. No. 462,135, Jan. 8, 1990, abandoned.

[51] Int. Cl.[5] ..... B65H 45/12

[52] U.S. Cl. ..... 493/409; 493/436; 493/438; 493/443; 53/381.7

[58] Field of Search ..... 493/408-410, 493/244, 245, 438, 443, 446, 447, 449, 456, 399, 248, 254, 406, 409, 436; 53/133.3, 381.5, 381.7, 387.2

[56] References Cited

U.S. PATENT DOCUMENTS

| | | | |
|---|---|---|---|
| 2,039,335 | 5/1936 | Nall | 493/399 |
| 3,974,749 | 8/1976 | Luperti | 53/381.7 |
| 4,410,316 | 10/1983 | Yoke | 493/399 |

FOREIGN PATENT DOCUMENTS

| | | | |
|---|---|---|---|
| 366814 | 7/1939 | Italy | 493/447 |

*Primary Examiner*—Bruce M. Kisliuk
*Assistant Examiner*—Jack Lavinder
*Attorney, Agent, or Firm*—Heller & Kepler

[57] ABSTRACT

An overbending device preferably for use with existing apparatus, such as a gumming apparatus, has ball bearings, fingers or other equivalent members for pressing down and a driven or freewheeling rolling disk for forcing up the adjacent sides of an envelope. The adjacent sides defined by a bend or a score line.

19 Claims, 2 Drawing Sheets

OVERBENDING DEVICE

This is a continuation of copending application Ser. No. 07/462,135, filed on Jan. 8, 1990, now abandoned.

BACKGROUND OF THE INVENTION

The present invention relates in general to overbending a folded member and pertains, more particularly to an overbending device for overbending a flap or folded sheet prior to applying a gum or other adhesive, or a sheet of paper or other material to the flap. The overbending device of this invention is an improvement over the conventional plowshare-type overbending devices.

With the conventional envelope making machines one or more flaps are folded to form a complete envelope. Gumming machines, however, typically bend a flap to position the flap for receipt of a gum or latex adhesive. The gum or adhesive is applied in order that the envelope may be sealed with pressure on the gummed portion, either with or without the application of water.

These self-sealing envelopes may require cooperating gum (e.g., latex) deposits applied to both a flap and an enclosure portion of the envelope that form a sealed envelope when pressed together, or pressure sensitive adhesive with a strip of paper material covering the adhesive.

The conventional overbending devices typically satisfy these requirements with a plow share folding member. It is further known to buckle an envelope and flap in order to over bend the flap. These conventional devices are either relatively ineffective, as in the plough share, or relatively complicated devices. The complications typically result from a necessity to manipulate an envelope in order to provide a desired orientation prior to any overbending step.

Accordingly, it is an object of the present invention to provide an improved overbending device that can be adapted for use with existing gumming apparatus. With the overbending device of this invention an additional station may be added to an existing gumming apparatus without substantial alteration or modification of the gumming apparatus.

Another object of the present invention is to provide an improved overbending device that is constructed to operate free of any particular timing requirements. The operation of this invention should only require a modification of the timing of the existing gumming apparatus stations to allow for the additional or altered distance the envelope travels between stations already associated in a timed relationship. A conventional apparatus is expanded, and computing revised timing requirements a simple matter of arithmetic.

A further object of the present invention is to provide an improved overbending device that is adapted to perform with less resistance than conventional overbending devices to thereby reduce the potential for an operational obstruction or other impediment to the desired operation of an associated apparatus, such as a gumming apparatus.

SUMMARY OF THE INVENTION

To accomplish the foregoing and other objects of this invention there is provided an overbending device for overbending a flap or folded sheet prior to applying a gum or other adhesive to the flap. The overbending device comprises a device for performing an overbending operation on an envelope and flap combination typically including a score or bend line which divides the envelope into a pair of opposing portions. The score or bend line already present encourages the desired bending of one opposing portion onto the other opposing portion.

The memory of the envelope and flap combination or similar member is typically desirable for a finished product, such as an envelope. However, the memory developed by the planar member or envelope material encourages the material to its bent or folded position even when it is desired to perform an assembly or other step in a process on a substantially flat or planar member.

The envelope or its equivalent is moved to and from the present invention by means for feeding the envelope to an overbending station. The overbending station includes means for forcing opposing portions of the planar member or envelope along the bend line in opposition to the desired bending.

In order to further facilitate the desired overbending a pressing means for pressing opposing portions of the member, envelope, or other similar item in opposition to the desired bend direction is provided. The pressing means resists movement of the member as it is forced against the desired bend along the score or bend line.

In the disclosed embodiment described herein, there are provided an envelope overbending device for use in association with a conventional gumming apparatus. The conventional gumming apparatus typically includes feed stations, a gumming station, and transfer conveyor. The overbending device may be combined with an otherwise conventional gumming apparatus, and in one preferred embodiment includes a first feed station for feeding an envelope from a conveyor to the overbending device.

The typical envelope will have already had a score line pressed into it when an associated flap or flaps were formed. It is understood that envelopes processed by a gumming apparatus are already formed and it is often necessary to substantially flatten the envelope so as to feed a substantially planar member to the gumming station or stations of the gumming apparatus.

The overbending station of one preferred embodiment includes a finger member located above the path of travel of the envelope as it is fed through the overbending station. The illustrated embodiment of this invention further includes a disk member mounted for rotation on a disk member support shaft. The disk member is mounted for rotation below a plane defined by the envelope as it is fed through the overbending station, typically on a table as the envelope passes from feed rollers to exit rollers.

The disk member includes a perimeter circumferential edge portion that extends above the plane defined by the envelope. The finger member includes an envelope engaging means that extends below the plane defined by the envelope.

Thus, it will be appreciated that the cooperation of the disk member and the finger member encourage the envelope and flap to over bend and maintain a substantially planar shape as the envelope is subsequently fed to a gumming roller for conventional adhesive or gum application. The gummed envelopes will often be packaged flat to keep an applied pressure adhesive from prematurely sealing an inadvertently sealed envelope.

These and other objects and features of the present invention will be better understood and appreciated from the following detailed description of one embodiment thereof, selected for purposes of illustration and shown in the accompanying drawing.

DETAILED DESCRIPTION

Figure 1:
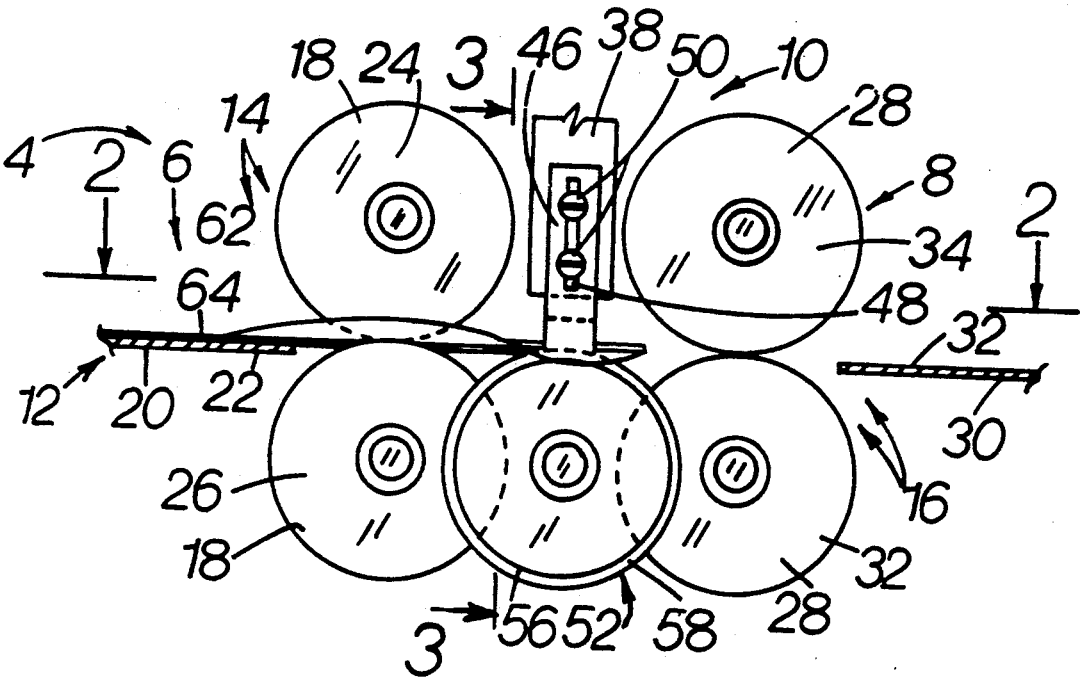
FIG. 1 is an elevation view of an overbending device constructed in accordance with the present invention.
Figure 2:
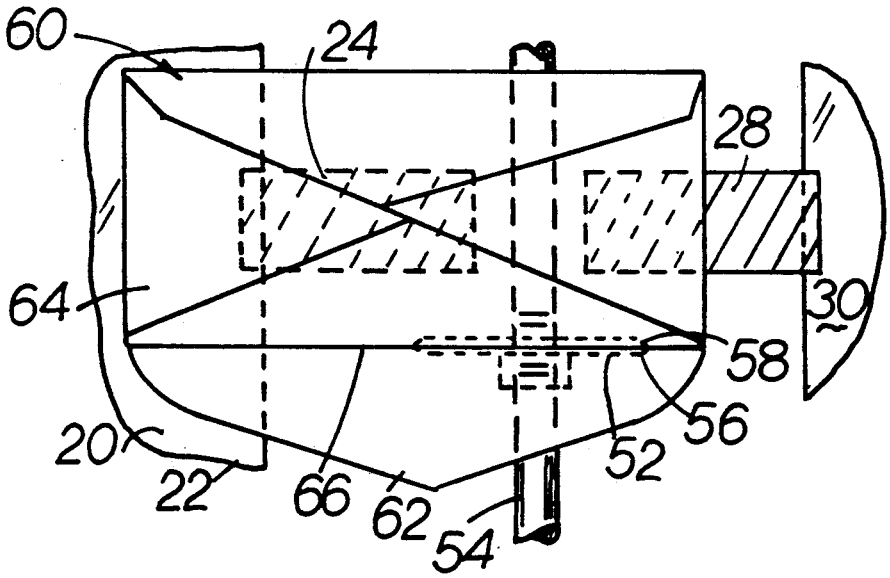
FIG. 2 is a cross-sectional view of the overbending device depicted in FIG. 1 taken along line 2—2 in FIG. 1.
Figure 3:
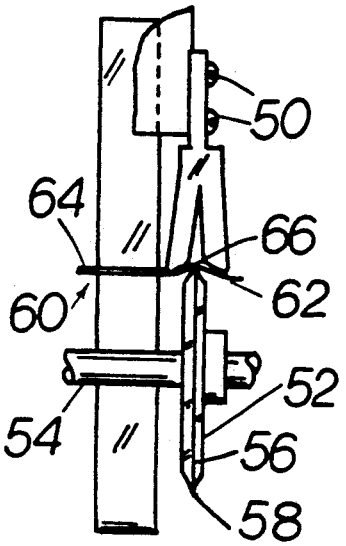
FIG. 3 is a cross-sectional view taken along line 3—3 in FIG. 1.
Figure 4:
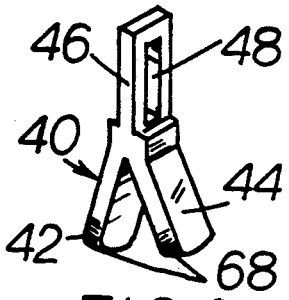
FIG. 4 is a perspective view of an element of the overbending device.
Figure 6:
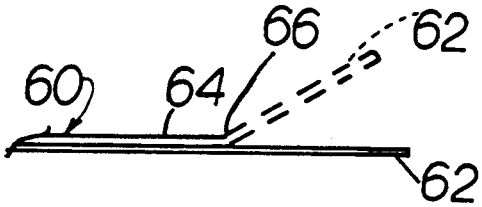
FIG. 6 is an enlarged section view of an envelope prior and subsequent to overbending.
Figure 5:
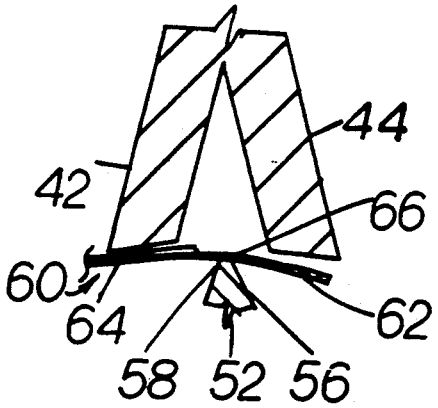
FIG. 5 is an enlarged section view of an envelope during overbending.

Referring now to the drawings there is shown a preferred embodiment for the overbending device of this invention. The overbending device is described in connection with a gumming apparatus for applying a gum or other adhesive to the flap or other surfaces of an envelope as will be understood by one skilled in the art. The overbending device of the present invention may be installed in a conventional gumming apparatus by one skilled in this field.

The overbending device of this invention is characterized by providing a flatter or more planar envelope flap and enclosure combination, readily receivable by a gumming station for application of a desired gum or adhesive.

The drawings show a portion of a typical gumming apparatus 4 including a feed station 6 and a gumming feed station 8 with an overbending device 10 of this invention installed intermediate these stations. The illustrated embodiment depicts the overbending device for use in an envelope gumming apparatus for overbending an envelope flap.

In a typical installation, an envelope 60 is transferred by conventional conveyor means, not shown, onto a conveyor table portion 12 where the envelope enters a first feed means 14. In a preferred embodiment the first feed means is a feed station as hereinafter described.

A second or downstream feed means 16 is located downstream of the overbending device 10. The upstream and downstream feed means typically include a set of upstream transfer rollers 18 for taking the envelope 60 which is transferred from an upstream conveyor bed 20 onto an upstream conveyor bed extension portion 22 by a conventional conveyor or similar mechanism. The envelope 60 is seized between an upper transfer roller and shaft combination 24 and a lower transfer roller and shaft combination 26.

Similarly, downstream of the overbending station or device 10, the downstream feed means 16 typically includes a set of downstream transfer rollers 28 for taking the envelope 60 from the overbending device 10 and transferring or moving the envelope to the next downstream station or device (not shown). In the illustrated embodiment, a second conveyor bed 30 includes an extension or table 32 onto which the envelope is transferred from the overbending device.

The remaining downstream portion of the gumming or other apparatus is not shown since it will be understood that it may vary depending upon the desired application and, therefore, does not form part of the present invention. The envelope 60 is seized between a roller portion of an upper downstream transfer roller and shaft combination 34 and another roller portion of a lower downstream transfer roller and shaft combination 36 and transferred to a downstream station, for example, a gumming station.

The overbending device or station 10 of a preferred embodiment includes a support member extension 38 located above the envelope path of travel. The extension member may be supported by any suitable portion of the gumming apparatus 4 or attached to a suitable portion of the apparatus. If no member is readily available, then it is within the ability of one skilled in the art to add a suitable support member understanding that the support member or extension is intended to support a finger member 40 or its equivalent over the envelope travel path.

The finger member 40 includes one finger 42 and another finger 44. The fingers are preferably attached to or integral with an adjustable support member 46 or other equivalent arrangement. The support member may include, as illustrated, a slot 48 and one or more fastening members 50 for adjusting the height of the finger member 40 and its plurality of depending fingers 42 and 44.

Figure 7:
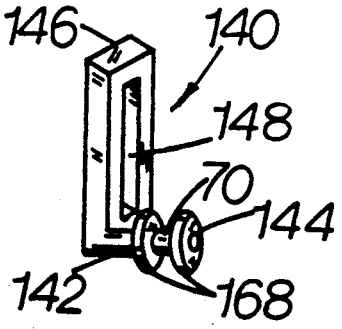
FIG. 7 depicts an alternative embodiment of the present invention.

In the illustrated embodiment, fingers 42 and 44 include contoured or beveled portions 68 for facilitating transfer of the member beneath the pressing portions of these fingers. It will be understood that other shapes or contours other than as specifically depicted in the accompanying drawings figures may also provide the desired function. For example, as illustrated in FIG. 7, a pair of the finger member 40' may include one rotating member 42' and another rotating member 44'.

The rotating members are preferably attached to an adjustable support member 46' by a shaft 70 providing for rotation of the members 42' and 44'. In one preferred embodiment the rotating members are paired ball bearings. The ball bearings define a gap over the disk below. This embodiment of a support member 40' may include the slot 48' and one or more fastening members (not shown) for adjusting the height of the finger member 40'.

Referring again to the illustrated embodiment in FIGS. 1 through 6, fingers 42 and 44 include contoured or beveled portions 68 for facilitating transfer of the member beneath the pressing portions of these fingers. The rolling surfaces 68' of the ball bearings 42' and 44' provide an equivalent to the contoured portions 68. Other equivalent structures will undoubtedly occur to those skilled in the art now that the present invention has been described.

A disk member 52 is located generally below the finger member 40 and beneath the envelope travel path. The disk member includes a support shaft 54 as illustrated. One preferred disk includes a tapered circumferential portion 56 defining a perimeter circumferential edge 58. The disk member provides forcing means for operating in conjunction with the pressing means, such as the fingers depicted in the drawing.

In operation, in connection with the gumming apparatus previously mentioned to apply gum or other adhesive to a flap 62 of the envelope 60, a plurality of envelopes are fed onto a feed conveyor of the gumming apparatus 4. In a typical application, the envelopes 60 include a previously formed conventional enclosure portion 64 and the previously mentioned flap 62. Typically, the flap 62 will be defined with respect to the enclosure portion 64 by a bend or score line 66, which was formed during the manufacture of the envelope 60.

The envelope(s) 60 are fed to the overbending station 10 in such a manner that the flap 62 will be in a correct position for operation of the overbending device. It is well known to those skilled in the art that envelopes must be fed such that the flap 62 is properly oriented for the overbending device, e.g., with respect to the plowshare style of overbending device. Since the means by which proper envelope orientation is obtained is not part of the present invention, rather already well understood, it will not be described further.

The drawings illustrate the single envelope 60 at several locations as it is processed by the overbending station 10 of this invention. The envelope 60 is transferred to the overbending station 10 by the upstream roller combination 18. As previously mentioned, the envelope is oriented such that the score line 66 is in register with the edge 58 of the disk member 52.

As the envelope 60 is transferred to the overbending station 10 the combination of the fingers 42, 44 and the disk member 52 cooperate to over bend the flap 62. Overbending the flap 62 results in a substantially planar envelope with enclosure portion 64 and flap 62. The disk member 52 is located such that the edge portion 58 in contact with the envelope is located above a plane defined by the conveyor and transfer members, and thus, also above the plane of the envelope 60.

It will be understood that the envelope 60 tends to roll up and over the disk member 52, however, fingers 42, 44 provide pressing means that resist the envelope and tend to force the envelope over the edge 58. In a preferred embodiment the tapered portion 56 of the circumference of the disk member 52 facilitates the breaking of the envelope and flap along the score line 66 as it rolls over the disk and allows a sharper reverse bend.

The sharper the taper of edge 58, the sharper the reverse or over bend created by the finger and disk combination along the score line 66. It is believed that the sharper edge more readily "erases" the memory of the flap to return it to its former shape, slightly inclined to the plane of the envelope enclosure. The relative sharper edge should allow the bend line or score line to be formed as the member passes through the overbending station.

Further facilitating the overbending is the rolling of the disk member 52 on the disk member support shaft. The rolling disk reduces resistance on the envelope and possible jamming of the device or damage to one or more envelopes since they can be fed through the device 10 and in fact the entire associated apparatus at a relatively high rate of speed.

It is believed possible that an embodiment of the present invention could include a fixed disk suitable for even conventional high speed operating equipment.

As illustrated, the fingers depend below the plane of the envelope and the disk edge extends above the plane of the envelope. The finger member is adjustable by loosening the fastening members 50 in the slot 48 and sliding the finger member 40 up or down as desired. Although not specifically illustrated, it will be within the ability of one skilled in the art to allow for the adjustment of the disk member 52 as well as the finger member 40.

If the style, weight, and material of the envelopes fed through the overbending device were to never change, then the relationship between the fingers and the disk could be fixed, to the extent practical. However, an apparatus intended for use with different weight and style envelopes, sheets, or other scored members, will be improved by the addition of the described adjustment feature or its equivalent.

It may be that the device 10 must operate on one project for standard envelopes, followed by a subsequent project for thicker larger envelopes, and followed by the application of an adhesive material to a prefolded sheet. The fingers could be lowered and the disk raised or some combination, thereby providing a more desirable device.

These and many of the other features of this invention are independent of the apparatus with which the invention is associated. The fingers, ball bearings, and the like, may be removed when material without flaps or with oversize or extended flaps is run through the associated machine.

The higher the disk or the lower the fingers the more of an overbending that can be accomplished. It is believed that continued use of this invention will teach the user specific vertical relationships for the disk and finger combination for particular materials.

In a preferred embodiment the envelope may be a standard Number 10, including an enclosure portion and a closure flap and a closure fold or bend line. The enclosure portion or body of the #10 envelope is nine and one half inches by four and one-eighth inches. The bend or score line forms the upper edge of the enclosure portion when the flap is closed.

It will be understood by one familiar with conventional gumming apparatus that the envelope enters the over bending station from a transfer station. The transfer station or a prior station of the gumming apparatus may unfold the flap to be gummed without overbending the flap. Subsequent to the overbending station of this invention, there may be a conventional gumming station or station for performing any other conventional operation on the envelope.

Therefore, it is not necessary to the disclosure of this invention to further describe any of the conventional operations of a gumming apparatus. As noted previously, it is one object of the present invention to provide an overbending device that can be adapted for use with conventional gumming apparatus. The overbending device of this invention provides the flexibility of including an additional station to an existing gumming apparatus or other known apparatus without substantial alteration or modification of the apparatus.

The freewheeling disk operation of the present invention allows the overbending device to operate free of any particular timing requirements with respect to associated transfer or conveyor stations. It will be understood that the addition of this invention could add greater length to the envelope path and thus require modification of the timing of the existing transfer or conveyor stations to allow for the additional or altered distance the envelope travels between these fixed stations.

Alternatively, the shaft 54 may be driven. In this embodiment the disk acts so as to provide a push for the envelope as it travels through the overbending station.

The overbending device performs with less resistance than conventional overbending devices and thereby reduces obstructions or impediments to the operation of associated apparatus, such as a gumming apparatus.

While specific embodiments have been shown and described, many variations are possible. The particular shape of the finger portion or disk portion of may be changed as desired to suit the equipment with which it is used. In fact, a disk shape is not required to perform the function of a member over which the pressing means bends the adjacent envelope portions separated and defined as they are by a score or a bend line.

As suggested the overbending device may be portable or set up as a separate station for more than one associated apparatus. The vertical orientation of the pressing means and the forcing means may be reversed without effecting operation of the present invention. It will be appreciated that turning the envelopes over rather than reversing these members before feeding the envelopes may be more suitable to efficient operation.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention by the appended claims and their equivalents.

What is claimed is:

1. An overbending device for a member including a bend line, the bend line generally defining adjacent planar member portions of the planar member, one adjacent planar member portion on either side of the bend line, the bend line encouraging the desired bending of one adjacent portion onto over the other adjacent portion, the overbending device comprising:

means for forcing a member in a direction against a preexisting bend line formed in the member, the forcing means acting in opposition to the direction of the bend produced by the pre-folded bend line, pressing means for pressing portions of the member, the pressing means acting on opposite sides of the bend line and in opposition to the desired bend direction, the pressing means resisting movement of the member due to the engagement of the forcing means with the member; and the forcing means including an edge portion operatively contacting the member generally along the reverse side of the bend line and the pressing means including engaging portions engaging the member, the pressing means engaging portions located sufficiently below a plane generally defined by the member and the forcing means edge portion located sufficiently above the plane, whereby operative cooperation of the forcing means and of the pressing means causes the member to over bend along the bend line in a direction in opposition to the desired bend direction so as to create a substantially, generally planar member.

2. An overbending device as set forth in claim 1 wherein forcing means comprises an edge member in which the edge member is oriented parallel to the bend line.

3. An overbending device as set forth in claim 2 wherein the edge member comprises a disk.

4. An overbending device as set forth in claim 3 wherein the disk is mounted for free wheeling rotation on a shaft.

5. An overbending device as set forth in claim 3 wherein the disk is mounted on a driven shaft.

6. An overbending device as set forth in claim 3 wherein the disk and shaft combination are adjustable.

7. An overbending device as set forth in claim 2 wherein the edge member is adjustable for movement with respect to the pressing means.

8. An overbending device as set forth in claim 1 wherein pressing means comprises fingers directed towards the bend line and at least one finger on each side of the bend line.

9. An overbending device as set forth in claim 1 wherein pressing means comprises rotating ball bearing directed towards the bend line and at least one ball bearing on each side of the bend line.

10. An overbending device as set forth in claim 1 wherein the pressing means is adjustable for movement with respect to the forcing means.

11. An overbending device as set forth in claim 1 wherein the pressing means is shaped for receiving the member between the pressing means and the forcing means.

12. An overbending device for use in preparing an envelope portion for receiving an adhesive, comprising:

means for feeding an envelope from an upstream station to an overbending device;

means for transferring the envelope from the overbending station to a next downstream station;

the overbending device including fingers positioned with respect to a pre-existing envelope score line defining a flap portion and an enclosure portion with at least one finger in register with each of these portions; and means for reverse breaking the flap and enclosure along the score line as the fingers press the flap and enclosure portion over the breaking means and thereby forming a substantially, generally planar envelope.

13. An overbending device as set forth in claim 12 wherein the fingers are adjustable with respect to the envelope.

14. An overbending device as set forth in claim 12 wherein the breaking means is adjustable with respect to the envelope.

15. An overbending device as set forth in claim 12 wherein the breaking means comprises a disk member.

16. An overbending device as set forth in claim 15 wherein the disk member rotates as the envelope is fed into the device and transferred to the next downstream station.

17. An overbending device as set forth in claim 12 wherein the overbending device is used to break any two adjacent portions of a sheet, in which the adjacent portions are divided by a score line.

18. An overbending device as set forth in claim 12 wherein the bend line is formed during overbending.

19. An envelope overbending device for use in association with a gumming apparatus, the gumming apparatus including feed stations, gumming station, and transfer conveyor, the overbending device, in combination with the gumming apparatus, comprising:

a first feed station for feeding an envelope with a score line from a conveying means associated with a gumming apparatus to an overbending station;

the overbending station including a finger member located adjacent a travel path of the envelope through the overbending station the finger member adjacent a back surface of the envelope;

the overbending station further including a disk member mounted for rotation on a disk member support shaft, the disk member mounted for rotation adjacent plane defined by the envelope and opposite the finger member on the opposite side of the envelope;

the disk member including a perimeter circumferential edge portion, the perimeter circumferential edge portion extending through the plane defined by the envelope; and the finger member including envelope engaging means acting on both sides of the score line, the envelope engaging means extending through the plane defined by the envelope such that the score line is overbent over the perimeter circumferential edge portion in a direction in opposition to a desired bend direction and along the score line thereby creating a substantially, generally planar envelope.

* * * * *

UNITED STATES PATENT AND TRADEMARK OFFICE

CERTIFICATE OF CORRECTION

PATENT NO. : 5,112,291

DATED : May 12, 1992

INVENTOR(S) : H. Richard VerMehren

It is certified that error appears in the above-indentified patent and that said Letters Patent is hereby corrected as shown below:

On the Title page, item [56] under References Cited, U.S Patent Documents insert the followings:

| | | | |
|---|---|---|---|
| 2,354,825 | 8/1944 | Novick | 93/62 |
| 2,748,675 | 6/1956 | Affelder | 93/62 |
| 3,367,249 | 2/1968 | Hornung | 93/61 |
| 3,450,009 | 6/1969 | Dohnalik | 93/62 |
| 3,980,006 | 9/1976 | Welch | 93/61 |
| 3,990,354 | 11/1976 | Ward et al. | 93/62 |
| 4,126,948 | 11/1978 | VerMehren | 34/150 |
| 4,138,933 | 2/1979 | Helm | 93/61 |
| 4,160,500 | 7/1979 | VerMehren | 198/457 |
| 4,210,318 | 7/1980 | VerMehren | 270/79 |
| 4,249,984 | 2/1981 | VerMehren | 156/552 |
| 4,257,514 | 3/1981 | VerMehren | 198/459 |
| 4,624,408 | 11/1986 | VerMehren | 229/69 |

Column 4, lines 35, 42, and 45, with reference to the finger member, numeral "40'" should read --140--;
Column 4, lines 36, 39, and 50, with reference to the rotating members (or ball bearings), numerals "42'" and "44'" should read --142-- and --144-- respectively;
Column 4, line 38, with reference to the support shaft, numeral "46'" should read --146--;
Column 4, line 43, with respect to the slot, numeral "48'" should read --148--; and

UNITED STATES PATENT AND TRADEMARK OFFICE

CERTIFICATE OF CORRECTION

PATENT NO. : 5,112,291

DATED : May 12, 1992

INVENTOR(S) : H. Richard VerMehren

It is certified that error appears in the above-indentified patent and that said Letters Patent is hereby corrected as shown below:

Column 4, line 50, with respect to the rolling surfaces, numeral "68" should read --168--.

Signed and Sealed this

Ninth Day of November, 1993

*Attest:*

*Attesting Officer*

BRUCE LEHMAN

*Commissioner of Patents and Trademarks*